US006260337B1

(12) United States Patent
Cheung

(10) Patent No.: US 6,260,337 B1
(45) Date of Patent: Jul. 17, 2001

(54) HAND STRAPPING TOOL

(75) Inventor: Nelson Cheung, Hoffman Estates, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/428,256

(22) Filed: Oct. 27, 1999

(51) Int. Cl.[7] ..... B65B 67/08
(52) U.S. Cl. ..... 53/592; 53/589
(58) Field of Search ..... 53/580, 582, 589, 53/592; 254/216, 218, 243, 199, 262; 81/185.1; 226/156, 194, 251, 256

(56) References Cited

U.S. PATENT DOCUMENTS 2,204,572 * 6/1940 Childress ..... 254/199
2,838,970 * 6/1958 Motches et al. ..... 81/185.1
2,943,524 * 7/1960 Bourne ..... 81/185.1
3,012,457 * 12/1961 Powell et al. ..... 81/185.1
3,284,049 * 11/1966 Haraden ..... 254/216
4,832,244 * 5/1989 Moriya ..... 226/115
5,029,433 * 7/1991 Werk ..... 53/592
5,224,642 * 7/1993 Davis et al. ..... 226/190
5,284,285 * 2/1994 Ferguson ..... 226/194
5,380,393 * 1/1995 Drabarek et al. ..... 156/358
5,425,487 * 6/1995 Saito et al. ..... 226/196
5,690,023 * 11/1997 Stamm et al. ..... 156/494

* cited by examiner

*Primary Examiner*—Peter Vo
*Assistant Examiner*—Nathaniel Chukwurah
(74) *Attorney, Agent, or Firm*—Donald J. Breh; Mark W. Croll; John P. O'Brien

(57) ABSTRACT

A hand strapping tool has a two-piece outer link assembly wherein a first upper outer link member is mounted upon a pivot shaft of the tool, while a second lower outer link member is mounted upon the distal end portion of the feedwheel shaft so as to maintain the feedwheel upon the feedwheel shaft. The second lower outer link member is removably fastened to the first upper outer link member by suitable fasteners whereby when the feedwheel is to be replaced as a result of, for example, wear thereof after the performance of numerous tensioning operations attendant the strapping of articles, objects, loads, or the like, only the lower outer link member needs to be disconnected from the upper outer link member so as to provide access to the feedwheel

17 Claims, 5 Drawing Sheets

HAND STRAPPING TOOL

FIELD OF THE INVENTION

The present invention relates generally to hand strapping tools, and more particularly to a new and improved hand strapping tool wherein the feed wheel mounting structure within the tool facilitates and simplifies the replacement of the feed wheel when necessary due, for example, to normal wear of the wheel as a result of its use within such hand strapping tools under strap tensioning conditions.

BACKGROUND OF THE INVENTION

Hand strapping tools are conventionally used to apply strapping material, made of either plastic, steel, or similar materials, around various articles, packages, or loads. In operating such a conventional hand strapping tool, the feed wheel, which is an element or component of the tool tensioning unit, is driven by a suitable motor drive and serves to tension the strapping material to a predetermined amount of tension as determined by stalling of the motor when the predetermined amount of tension level is attained. Subsequently, the strapping is joined and severed and a new article, package, load, or the like is readied for a strapping operation. As a result of such multiple strapping operations involving such tensioning processes, feed wheels undergo wear and therefore need to be replaced. However, with conventional hand strapping tools, the replacement of the feed wheel is not especially convenient and is quite time-consuming as can be better appreciated as a result of reference being made to FIGS. 1 and 2 of the drawings.

FIGS. 1 and 2 disclose a conventional hand strapping tool which is generally indicated by the reference character 10. Briefly, the hand strapping tool 10 comprises a tension unit 12 which includes a motor drive, not shown, and a gearbox 14 operatively connected to the tension unit motor drive. An output feedwheel shaft 16 projects laterally outwardly from one side of the gearbox portion 14 of the tension unit 12, and a portion of the external periphery of the feedwheel shaft 16 has a hexagonal configuration. A feedwheel 18, having a complementary internal hexagonal peripheral surface, is adapted to be mounted upon the feedwheel shaft 16 so as to be driven by the feedwheel shaft 16 as a result of the driving force generated by the tension unit motor drive and transmitted by the gearbox 14. The feedwheel shaft 16 passes through an aperture 19 of a breaker foot 20, and the feedwheel 18 is maintained upon the outer or distal end of the feedwheel shaft 16 by means of an outer link 22, the outer link 22 also being provided with an aperture 23 through which the free or distal end of the feedwheel shaft 16 passes. The outer link 22 is in turn mounted upon a position link 24 by means of a pin 26, wherein the position link 24 and pin 26 comprise a sub-assembly. Position link 24 is mounted upon a support rod 28 through means of another pin 30. A hanger rod 32, as shown in FIG. 2, has casting flanges or mounting brackets 34, only one of which is shown in FIG. 2, mounted thereon upon respective opposite sides of the tool.

The tension unit 12, the feedwheel assembly comprising the feedwheel shaft 16 and the feedwheel 18, and the outer link 22 are mounted upon casting flanges 34 through means of a pivot shaft 36 and a nut 38. The pivot shaft 36 and nut 38 permit the tension unit 12, the feedwheel assembly comprising the feedwheel shaft 16 and the feedwheel 18, and the outer link 22 to be pivotally movable between operative and inoperative positions with respect to upper and lower straps which are to be tensioned and joined together and which are shown at 42 and 44 respectively. The pivot shaft 36 is seen to extend or pass through apertures 37,39, 41, and 43 respectively provided within the casting flange 34, outer link 22, breaker foot 20, and the gearbox portion 14 of the tension unit 12. The motor drive of the tension unit 12 is activated by means of a manual trigger lever 40.

It can thus be appreciated that when the feedwheel 18 needs to be replaced, the pivot shaft 36 must first be removed from the tool 10 whereby the entire tension unit assembly comprising the tension unit 12, the feedwheel shaft 16 and feedwheel 18, and the outer link 22 are disengaged and able to be removed from the casting flanges 34. The outer link 22 and the pin 26 must then be removed as a sub-assembly from the position link 24 whereby access to the feedwheel 18 upon the feedwheel shaft 16 is then achieved such that the worn feedwheel 18 can now be replaced. Once the new feedwheel has been placed upon the feedwheel shaft 16, the reverse procedures concerning the disposition or mounting of the outer link 22 and pin 26 upon the position link 24, as well as the disposition or mounting of the entire tension unit assembly upon the casting flanges 34 by means of the pivot shaft 36, must then be performed. It can therefore be appreciated that replacement procedures with respect to the feedwheel 18, comprising the disassembly of the tool component parts, and the re-assembly of such parts, as noted hereinabove, can be quite time-consuming.

A need therefore exists in the art for a hand strapping tool wherein the structural assembly of the tension unit, and in particular, the mounting of the feedwheel thereon, is such that replacement of the feedwheel as necessary due to wear or other conditions, is considerably simplified in order to render the replacement procedure for the feedwheel relatively easy, straightforward, and quick with minimum production downtime.

OBJECTS OF THE INVENTION

Accordingly, it is an object of the present invention to provide a new and improved hand strapping tool.

Another object of the present invention is to provide a new and improved hand strapping tool which effectively overcomes the various structural drawbacks of conventional hand strapping tools.

An additional object of the present invention is to provide a new and improved hand strapping tool wherein the structural mounting of the feedwheel upon the tension unit is such as to render the exchange or replacement of the feedwheel relatively simple, straightforward, and quick so as to minimize production downtime.

A further object of the preset invention is to provide a new and improved hand strapping tool wherein the improved structural mounting of the feedwheel upon the tension unit comprises a minimum number of component parts such that conventional or existing hand strapping tools may be easily and readily retrofitted.

SUMMARY OF THE INVENTION

The foregoing and other objectives are achieved in accordance with the teachings of the present invention through the provision of a new and improved hand strapping tool wherein the mounting structure for the feedwheel assembly comprises a two-part or two-piece outer link comprising an upper outer link member and a lower outer link member. The upper outer link member is mounted upon the pivot shaft in a manner similar to the outer link members of the existing or conventional hand strapping tools, whereas the lower link member is disposed upon the outer or distal end of the feed-wheel shaft so as to maintain the feedwheel mounted upon the feedwheel shaft. The lower link member is fixedly secured to the upper link member by means of two bolt or threaded fasteners. Accordingly, when the feedwheel needs to be replaced, the two bolt or threaded fasteners are simply removed from the outer link assembly comprising the upper outer link member and the lower outer link member whereby the lower outer link member is now able to be removed from the upper outer link member as well as from the outer or distal end of the feedwheel shaft thereby exposing or providing access to the feedwheel which may now be replaced. When the feedwheel is replaced, the lower outer link member is simply replaced upon the outer or distal end of the feed-wheel shaft, and the two bolt or threaded fasteners are reinserted so as to fixedly mount the lower outer link member upon the upper outer link member and thereby maintain the lower outer link member upon the feedwheel shaft so as to in turn maintain the feedwheel upon the feedwheel shaft.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts through-out the several views, and wherein.

DETAILED DESCRIPTION OF THE PREFERRED EMBODIMENT

Figure 2:
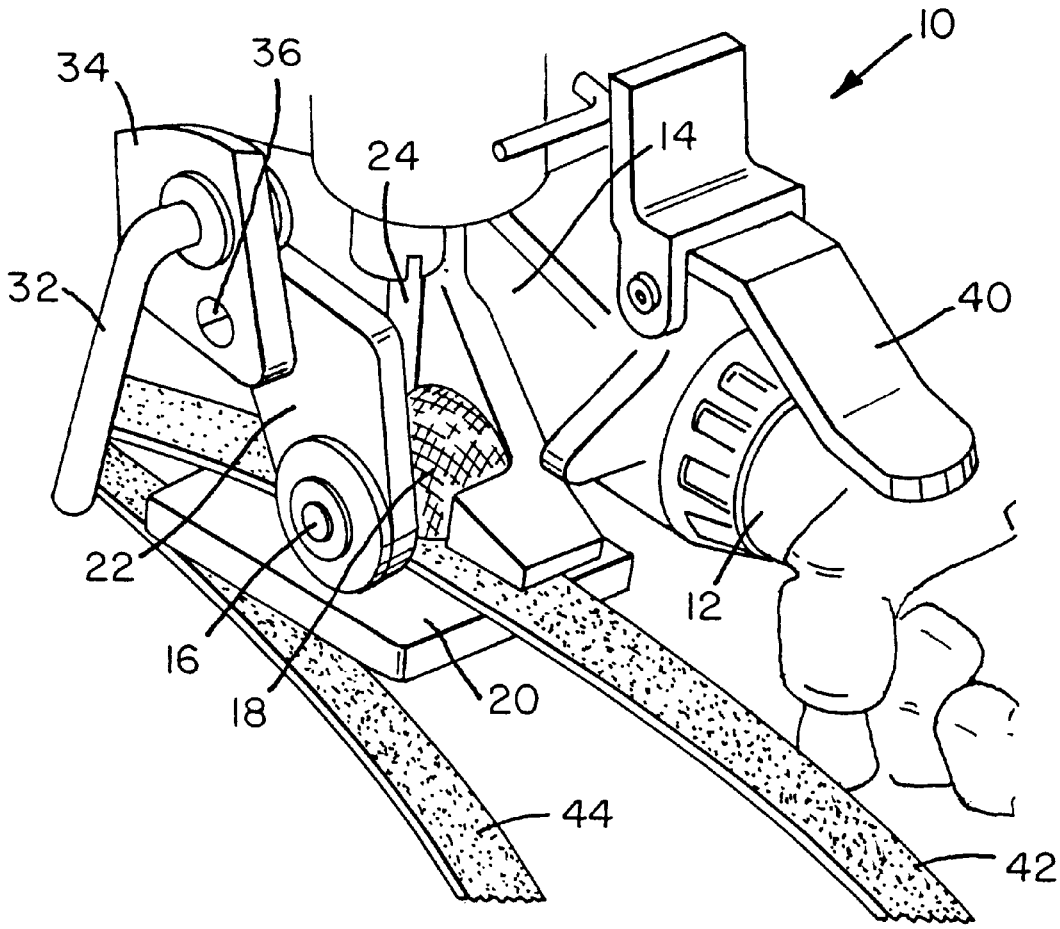
FIG. 2 PRIOR ART
FIG. 2 is a partial perspective view showing the hand strapping tool of FIG. 1 in its assembled state.
Figure 3:
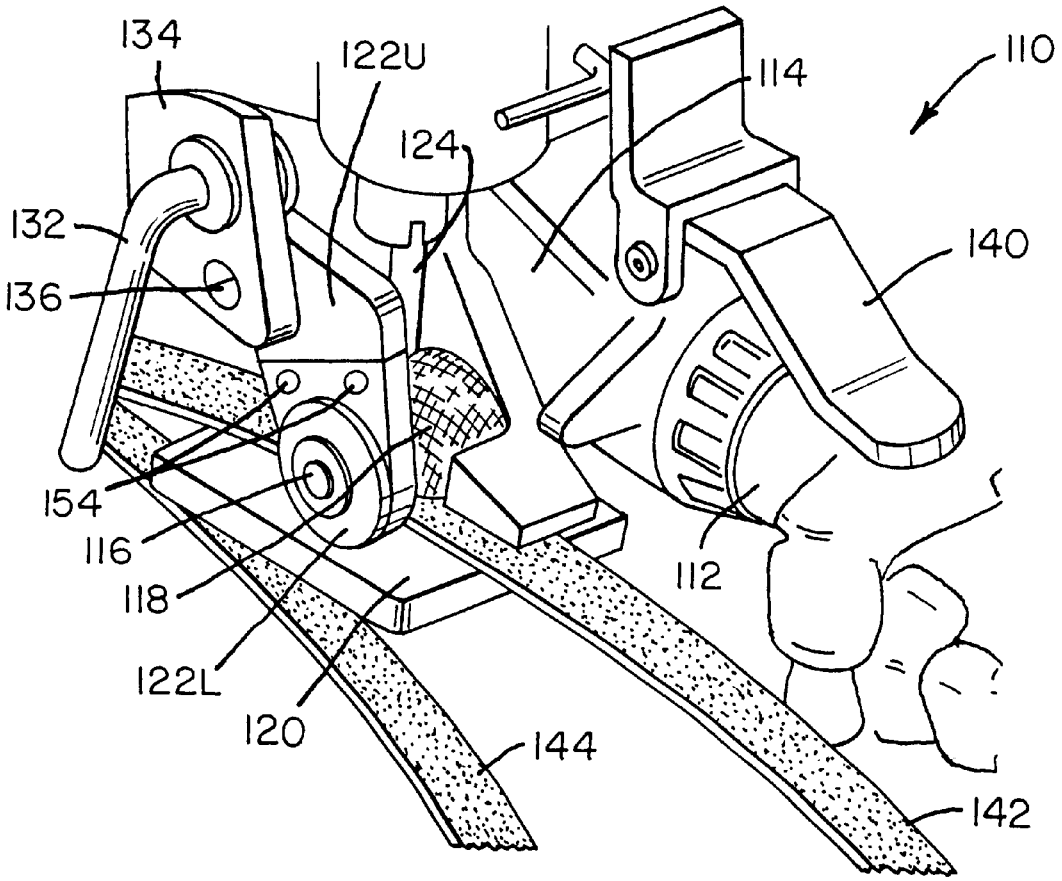
FIG. 3 is a partial perspective view similar to that of FIG. 2 wherein, however, a hand strapping tool constructed in accordance with the principles and teachings of the present invention and having the new and improved feedwheel mounting system incorporated therein is disclosed.

Referring now to the drawings, and more particularly to FIG. 3 thereof, the new and improved hand strapping tool constructed in accordance with the teachings and principles of the present invention is disclosed and is generally indicated by the reference character 110, while FIGS. 4–7 disclose the details of the new and improved upper and lower outer link components which comprise the essential component parts of the new and improved feedwheel mounting system incorporated within the tool 110. It is also noted that the hand strapping tool 110 disclosed within FIG. 3 is essentially the same as that disclosed within FIG. 2, except as will be specifically noted hereinafter, and therefore those parts of the tool 110 which correspond to similar parts of the tool 10 disclosed within FIG. 2 are designated by similar reference characters except that the reference characters of the parts of the tool 110 as disclosed within FIG. 3 are in the 100 series.

Figure 1:
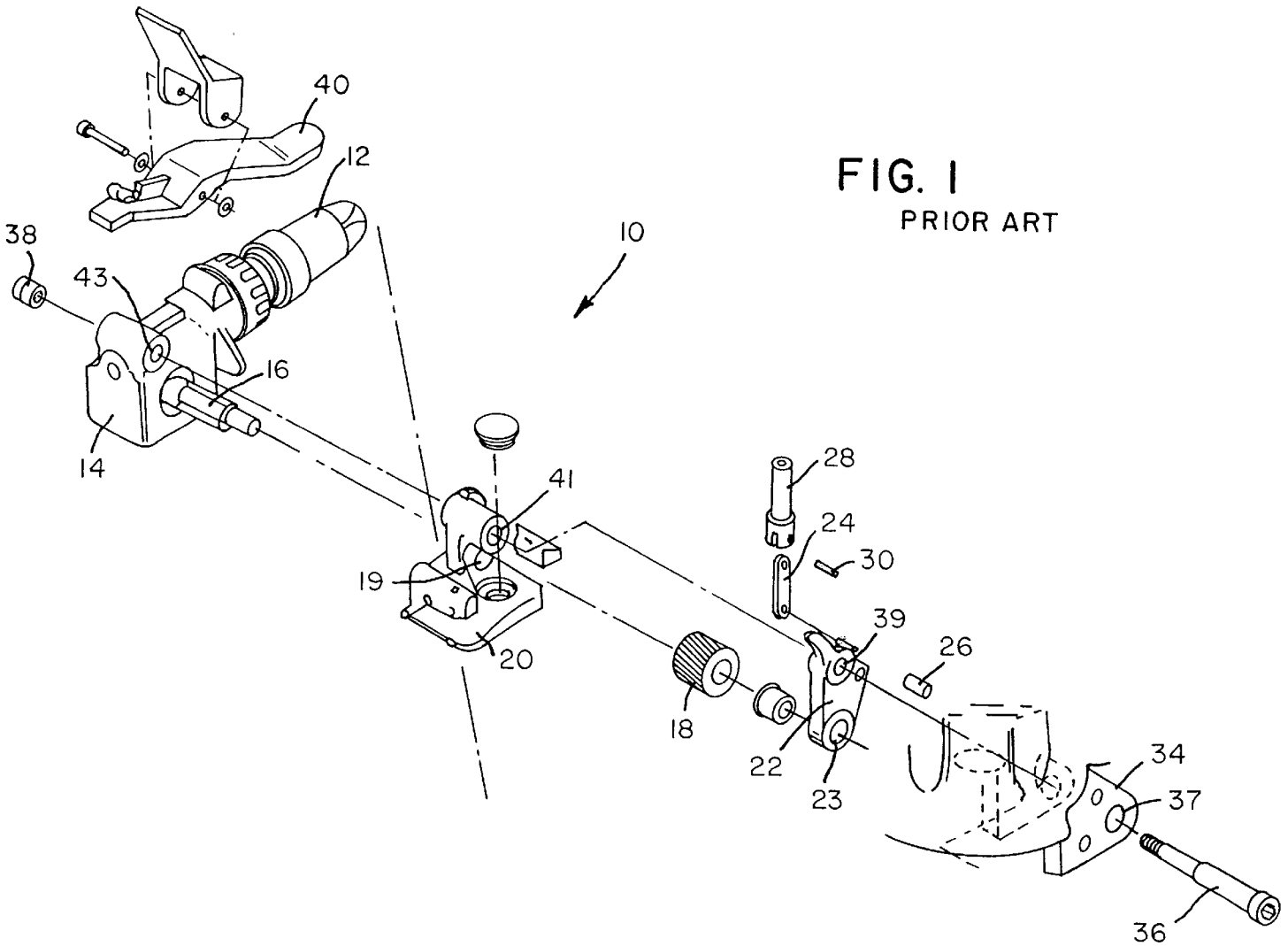
FIG. 1 PRIOR ART
FIG. 1 is an exploded perspective view of some of the component parts comprising a conventionally existing PRIOR ART hand strapping tool.

Referring then to FIG. 3, it is briefly seen that the hand strapping tool 110 comprises the tension unit 112 which has the gearbox 114 operatively associated therewith. The feedwheel 118 is mounted upon the feedwheel shaft 116, and the pivot shaft is shown at 136. However, it is critically noted that in lieu of the single outer link component or member 22 which mounts the tension unit 12 upon the pivot shaft 36 as disclosed in accordance with the structural arrangement of the PRIOR ART hand strapping tool disclosed in FIGS. 1 and 2, there is provided a two-part or two-piece outer link sub-assembly which comprises an upper outer link member 122U and a lower outer link member 122L.

Figure 4:
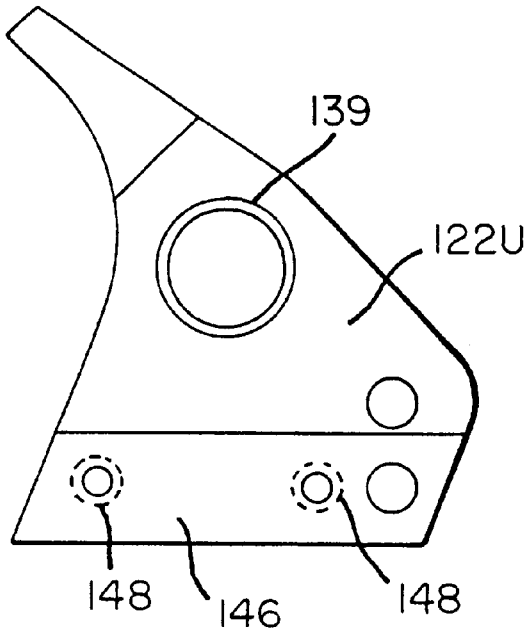
FIG. 4 is a front elevational view of the upper outer link component of the new and improved feedwheel mounting system of the present invention as incorporated within the hand strapping tool of FIG. 3.
Figure 6:
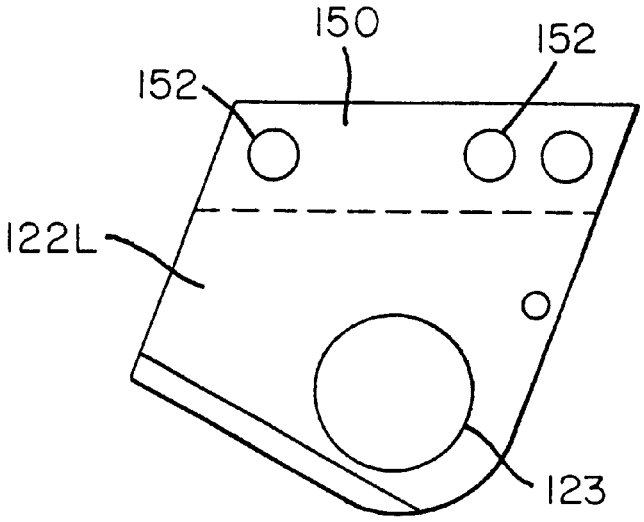
FIG. 6 is a front elevational view of the lower outer link component of the new and improved feedwheel mounting system of the present invention as incorporated within the hand strapping tool of FIG. 3.
Figure 5:
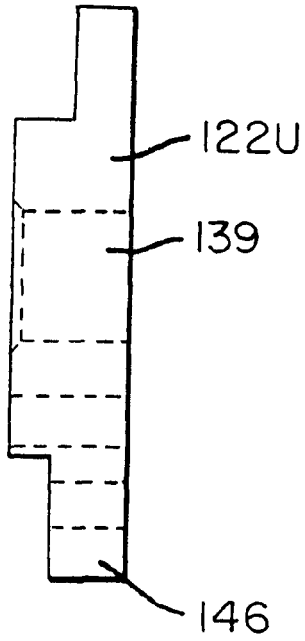
FIG. 5 is a side elevational view of the upper outer link component of the new and improved feedwheel mounting system of the present invention as shown in FIG. 4.
Figure 7:
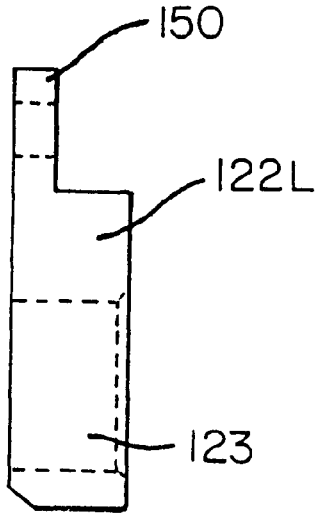
FIG. 7 is a side elevational view of the lower outer link component of the new and improved feedwheel mounting system of the present invention as shown in FIG. 6.

More particularly, with additional reference also being made to FIG. 4, it is seen that the upper outer link member 122U is provided with an aperture 139 through which the pivot shaft 136 is inserted so as to mount the upper outer link member 122U, as well as the breaker foot 120 and the gearbox portion 114 of the tension unit 112 upon the casting flange or mounting bracket 134. As can be further appreciated as a result of additional reference being made to FIG. 5, the lower portion of the upper outer link member 122U also comprises a dependent flanged portion 146 which is set back rearwardly with respect to the front face of the upper outer link member 122U and within which a pair of apertures 148, 148 are provided. With additional reference being made to FIGS. 6 and 7, it is seen that the lower outer link member 122L is provided with an aperture 123 through which the free or distal end portion of feedwheel shaft 116 is disposed, and the upper portion of the lower outer link member 122L is provided with an upstanding flanged portion 150 which is disposed forwardly with respect to the rear face of the lower outer link member 122L and within which a pair of apertures 152,152 are provided. The flanged portions 146 and 150 of the upper and lower outer link members 122U,122L, respectively, comprise complementary structural configurations such that the upper and lower outer link members 122U,122L can be fixedly fastened together when the flanged portions 146 and 150 thereof are disposed in an abutting overlapping disposition with respect to each other and suitable bolt or threaded fasteners 154,154, as shown in FIG. 3, are inserted through the sets of apertures 148 and 152.

With particular reference lastly being made to FIG. 3, it can therefore be readily appreciated that as a result of the particular structural arrangement developed in accordance with the teachings and principles of the present invention by means of which there is provided the two-piece or two-part outer link assembly comprising the upper outer link member 122U and the lower outer link member 122L for mounting and maintaining the disposition of the feedwheel 118 upon the hand strapping tool 110, when the feedwheel 118 is to be replaced, such procedure is simply and quickly accomplished by simply removing the lower outer link member 122L from the upper outer link member 122U as a result of removing the fasteners 154,154. The lower outer link member 122L may then be simply removed from the free or distal end portion of the feedwheel shaft 116, and the feedwheel 118 may then be similarly removed and replaced with a new feedwheel. The lower outer link member 122L may then be simply remounted upon the upper outer link member 122U as a result of reinserting the fasteners 154,154. Thus, the pivot shaft 136 need not be removed from the tool assembly, and similarly, the entire tension unit assembly, including the upper outer link member 122U, need not be removed from the tool assembly, that is, for example, from the casting flanges 134,134 as well as from the position link 124.

Thus, it may be seen that as a result of the aforenoted structural arrangement or system, replacement of the feedwheel is readily simplified, is able to be accomplished quickly and easily, and production downtime is minimized. In addition, by replacing conventional one-piece outer link members, currently in position and in use upon conventional PRIOR ART hand strapping tools, with the new and improved two-piece or two-part outer link structural system, such conventional PRIOR ART hand strapping tools may be readily retrofitted so as to substantially improve the utility and service of such tools from a production point of view.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A hand strapping tool, comprising:

a mounting bracket;

a tension unit;

a feedwheel shaft operatively connected-at a first proximal end portion thereof to said tension unit, and having a second distal end portion;

a feedwheel mounted upon said feedwheel shaft;

a pivot shaft for pivotally mounting said tension unit upon said mounting bracket; and an outer link for maintaining said feedwheel upon said feedwheel shaft, said outer link comprising a first outer link member mounted upon said pivot shaft, and a second outer link member mounted upon said distal end portion of said feedwheel shaft and removably fastened to said first outer link member, whereby when said feedwheel is to be removed from said feedwheel shaft, only said second outer link member need be disconnected from said first outer link member.

2. The hand strapping tool as set forth in claim 1, wherein:

said first outer link member comprises a dependent flanged portion; and said second outer link member comprises an upstanding flanged portion complementary to said dependent flanged portion of said first outer link member.

3. The hand strapping tool as set forth in claim 2, wherein:

said first outer link member comprises a first pair of apertures defined within said dependent flanged portion for receiving fasteners for fastening said first and second outer link members together; and said second outer link member comprises a second pair of apertures defined within said upstanding flanged portion for receiving the fasteners for fastening said first and second outer link members together.

4. The hand strapping tool as set forth in claim 2, wherein:

said first outer link member has a front surface, and said first dependent flanged portion of said first outer link member is set back rearwardly from said front surface of said first outer link member; and said second outer link member has a rear surface, and said second upstanding flanged portion of said second outer link member is disposed forwardly from said rear surface of said second outer link member.

5. The hand strapping tool as set forth in claim 1, wherein:

said first outer link member comprises an upper outer link member; and said second outer link member comprises a lower outer link member.

6. The hand strapping tool as set forth in claim 1, further comprising:

fastener means for fixedly fastening said second outer link member to said first outer link member.

7. A hand strapping tool, comprising:

a mounting bracket;

a tension unit;

a feedwheel shaft operatively connected at a first proximal end portion thereof to said tension unit, and having a second distal end portion;

a feedwheel mounted upon said feedwheel shaft;

a pivot shaft for pivotally mounting said tension unit upon said mounting bracket; and a first upper outer link member mounted upon said pivot shaft, and a second lower outer link member removably fastened to said first upper outer link member and mounted upon said distal end portion of said feedwheel shaft so as to maintain said feedwheel upon said feedwheel shaft, whereby when said feedwheel is to be removed from said feedwheel shaft, only said second lower outer link member need be disconnected from said first outer link member.

8. The hand strapping tool as set forth in claim 7, wherein:

said first upper outer link member comprises a dependent flanged portion; and said second lower outer link member comprises an upstanding flanged portion complementary to said dependent flanged portion of said first upper outer link member.

9. The hand strapping tool as set forth in claim 8, wherein:

said first upper outer link member comprises a first pair of apertures defined within said dependent flanged portion for receiving fasteners for fastening said first and second upper and lower outer link members together; and said second lower outer link member comprises a second pair of apertures defined within said upstanding flanged portion for receiving the fasteners for fastening said first and second upper and lower outer link members together.

10. The hand strapping tool as set forth in claim 8, wherein:

said first upper outer link member has a front surface, and said first dependent flanged portion of said first upper outer link member is set back rearwardly from said front surface of said first upper outer link member; and said second lower outer link member has a rear surface, and said second upstanding flanged portion of said second lower outer link member is disposed forwardly from said rear surface of said second lower outer link member.

11. The hand strapping tool as set forth in claim 7, further comprising:

fastener means for fixedly fastening said second lower outer link member to said first upper outer link member.

12. In a hand strapping tool including a mounting bracket, a tension unit, a feedwheel shaft operatively connected at a first proximal end portion thereof to said tension unit and having a second distal end portion, a feedwheel mounted upon said feedwheel shaft, a pivot shaft for pivotally mounting said tension unit upon said mounting bracket, and an outer link for maintaining said feedwheel upon said feedwheel shaft, the improvement comprising:

said outer link comprising a first outer link member mounted upon said pivot shaft, and a second outer link member mounted upon said distal end portion of said feedwheel shaft and removably fastened to said first outer link member, whereby when said feedwheel is to be removed from said feedwheel shaft, only said second outer link member need be disconnected from said first outer link member.

13. The hand strapping tool as set forth in claim 12, wherein:

said first outer link member comprises a dependent flanged portion; and said second outer link member comprises an upstanding flanged portion complementary to said dependent flanged portion of said first outer link member.

14. The hand strapping tool as set forth in claim 13, wherein:

said first outer link member comprises a first pair of apertures defined within said dependent flanged portion for receiving fasteners for fastening said first and second outer link members together; and said second outer link member comprises a second pair of apertures defined within said upstanding flanged portion for receiving the fasteners for fastening said first and second outer link members together.

15. The hand strapping tool as set forth in claim 13, wherein:

said first outer link member has a front surface, and said first dependent flanged portion of said first outer link member is set back rearwardly from said front surface of said first outer link member; and said second outer link member has a rear surface, and said second upstanding flanged portion of said second outer link member is disposed forwardly from said rear surface of said second outer link member.

16. The hand strapping tool as set forth in claim 12, wherein:

said first outer link member comprises an upper outer link member; and said second outer link member comprises a lower outer link member.

17. The hand strapping tool as set forth in claim 12, further comprising:

fastener means for fixedly fastening said second outer link member to said first outer link member.

* * * * *